United States Patent [19]

Gregg et al.

[11] 3,948,365

[45] Apr. 6, 1976

[54] MOBILE LUGGAGE CASE

[75] Inventors: James S. Gregg, Denver; Robert W. Miller, Watkins; Lawrence R. Mobley, Parker; Charles J. Scott; Joseph A. Woodburn, both of Denver, all of Colo.

[73] Assignee: Samsonite Corporation, Denver, Colo.

[22] Filed: Dec. 16, 1974

[21] Appl. No.: 533,337

[52] U.S. Cl. ..... 190/18 A

[51] Int. Cl.[2] ..... A45C 5/14; A45C 13/26

[58] Field of Search ..... 190/18 R, 18 A; 280/47.17, 280/47.19, 47.26, 43.24, 37

[56] References Cited

UNITED STATES PATENTS

| | | | |
|---|---|---|---|
| 2,893,749 | 7/1959 | Simonsen | 280/47.19 |
| 3,537,721 | 11/1970 | Warner | 280/47.17 |
| 3,799,568 | 3/1974 | Hager | 190/18 A X |
| 3,805,929 | 4/1974 | Kuwayama | 190/18 A |

*Primary Examiner*—Donald F. Norton
*Attorney, Agent, or Firm*—George J. Netter

[57] ABSTRACT

The luggage case has a pair of wheels located at a lower back edge such that when the case rests on a flat surface, the wheels are held spaced from the floor surface. On lifting the case side opposite that including the wheels, the wheels are brought into rolling contact with the floor. A handle assembly is foldably received into the side wall opposite that including the wheels and can be selectively folded outwardly into a position for pulling or pushing, or, when not in use, folded into a receiving recess formed in the case side wall. A spring-loaded latch mechanism secures the handle within the recess during nonuse, and a finger release enables selective extension of the handle outwardly from the case wall for easy access when it is desired to move the case.

13 Claims, 11 Drawing Figures

4
4
5
5

FIG. 7.
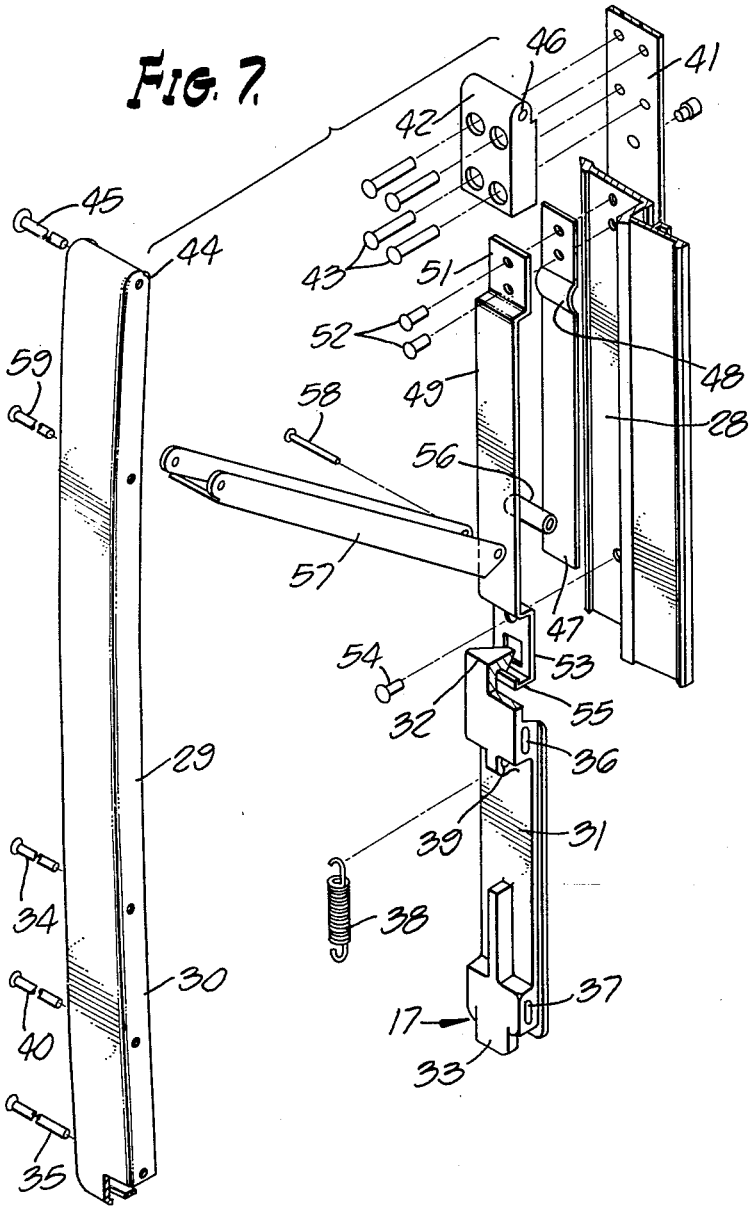
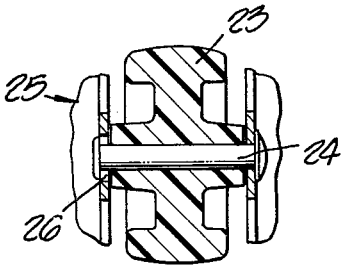
FIG. 8A.
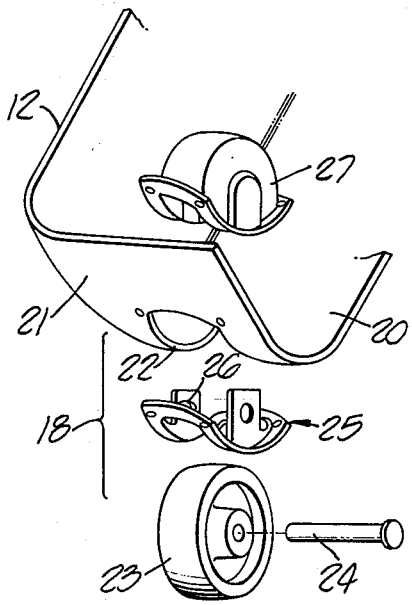
FIG. 9.
FIG. 8.
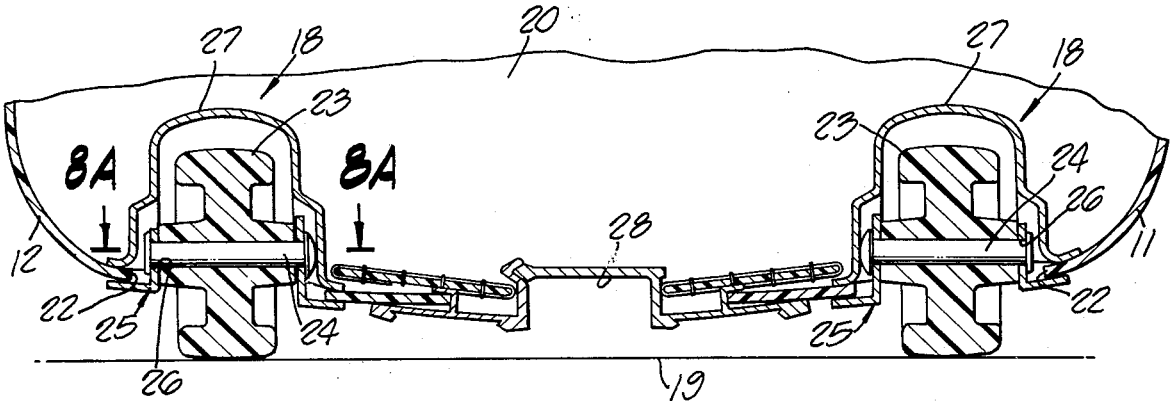

MOBILE LUGGAGE CASE

The present invention relates generally to a luggage case, and, more particularly, to such a luggage case which is mobile through the cooperation of wheel and handle apparatus integral with said case.

SUMMARY OF THE INVENTION

A primary aim and object of the present invention is to provide a luggage case having improved transport apparatus incorporated therein, making movement of the luggage case simpler and easier.

A further object is the provision of mobile luggage having a foldable handle adjustable to extended position by finger pressure.

Yet another object is the provision of a luggage case which may be pulled or pushed and has a rest mode wherein the case lower wall is frictionally secured against movement throughout a predetermined range of tilt angles.

In the practice of this invention, a luggage case is provided having a pair of wheels located at the lower back edge thereof. The wheels are so mounted to the luggage case that when the case is resting flat on a flat horizontal surface, the wheels are held spaced from the floor surface, however, on lifting the case side opposite that including the wheels, the wheels rollingly contact the floor. A handle assembly is foldably received into the side wall opposite that including the wheels which can be selectively folded outwardly into a pulling (or pushing) position, or, when not in use, is folded back into a receiving recess formed into the case side wall. A spring-loaded latch mechanism secures the handle within the recess during nonuse, and a finger release causes the handle to extend outwardly from the case wall for easy access when it is desired to pull or push the case.

DESCRIPTION OF THE DRAWINGS

FIG. 7 is an exploded view of the handle apparatus, showing the various parts.

FIG. 8 is a sectional view taken along the line 8—8 of FIG. 2 through the wheels of the case.

FIG. 8A is a sectional view taken along the line 8A—8A of FIG. 8.

FIG. 9 is an exploded view of one of the wheel assemblies.

DESCRIPTION OF A PREFERRED EMBODIMENT

Figure 1:
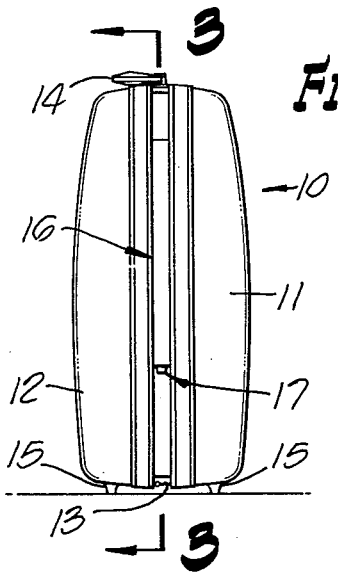
FIG. 1 is an end elevational view of the luggage case of this invention.
Figure 2:
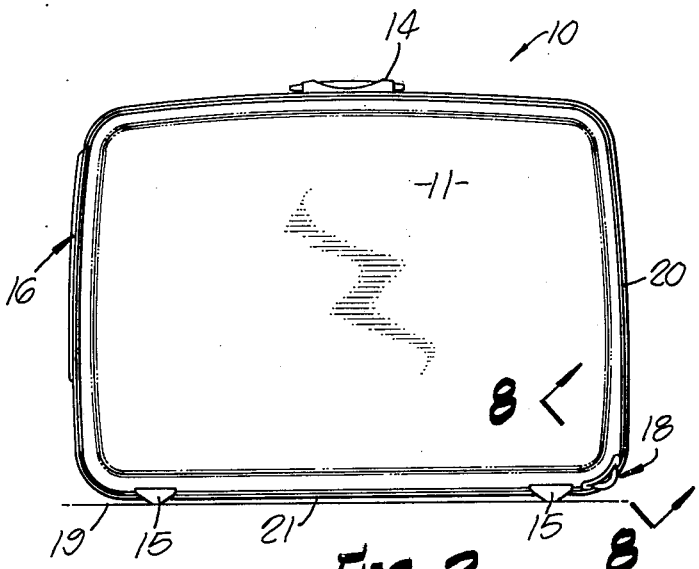
FIG. 2 is a side elevational view of the luggage case showing the handle in retracted position and the case in rest mode.

With reference now to the drawing, and, in particular, FIGS. 1 and 2 thereof, the luggage case of this invention, identified generally as at 10, is seen to include first and second shells 11 and 12 secured together along a common edge by hinge 13. Handle 14 is provided at the top of the case for carrying in the usual manner. Four feet 15, two adjacent each end of the case, are provided on the lower surface of the shells 11 and 12 and on which the case rests when set upon the ground or other horizontal surface. A handle assembly 16 (which, although it may be used optionally for either pulling or pushing will be referred to in the ensuing description as a "pulling" handle assembly), is selectively extendable from an end wall or panel by simple manipulation of a latch 17.

On the lower corner or edge opposite that side of the case containing the pulling handle assembly 16, there is provided a pair of wheels 18 which extend diagonally outwardly from the case outer surface. That is, when the case is resting on the feet 15 as shown in FIG. 2, the wheels 18 are maintained spaced from the floor 19. However, as will be more clearly described, when the handle assembly 16 is extended (FIG. 10) and a lifting force applied, the entire luggage case is pivoted about the feet 15 closely adjacent to the wheels 18 and then raised to a point such that the wheels 18 contact the floor 19 enabling the case to be pulled.

With reference now to FIGS. 1, 2, 8 and 10, simultaneously, the ensuing description of the wheel assembly 18 is given. Each of the luggage case shells 11 and 12 includes a wheel assembly 18, located at the intersection of the respective rear end and bottom panels 20 and 21. More particularly, the wheel assemblies are received within wells formed in the shells 11 and 12 with wheel parts extending outwardly of the case outer surface for rotation about a common axis normal to the major side panels of the luggage case.

As already alluded to, four feet 15 are provided on the case bottom wall 21. Two of the feet are located (one on the bottom wall of each of the shells 11 and 12) closely adjacent the front end panel which includes the extendable handle apparatus 16. The other two feet 15 are located spaced from the rear end wall 20 (one on each shell bottom panel) and aligned transversely of the bottom.

The rear set of feet 15 are spaced from the wheel assembly at a distance and project outwardly from the case lower panel such that with the case resting on a flat surface 19, the case must be tipped at an angle of approximately 13° before the wheel parts contact the surface 19. This insures a broad range of resting stability for the luggage case, which will be commented on later in more detail.

As can best be seen in FIG. 9, the lower rear corner or corner edge of each shell 11 and 12 includes an opening 22 within which the wheel assembly 18 is received. Specifically, a wheel 23 has an axle 24 affixed thereto, the ends of which are rotatably secured within a journal frame 25. More particularly, each journal frame has one elongated opening 26 within which an end portion of an axle 24 is rotatably received, thereby providing self-alignment during use. Also, the journal is so dimensioned for receipt within the opening 22 and has external parts conforming to the case shell via rivets, for example, leaving a portion of the wheel periphery extending outwardly of the case shell. The parts of the journal and wheel extending into the case interior are enclosed by a cover 27, also riveted or otherwise secured to the inside of the case shell.

Although in the preceding description of the wheel assembly details, reference has been made solely to the wheel assembly associated with the case shell 12, it is to be understood that the construction of the other wheel assembly mounted to the shell 11 is identical and for that reason a separate description is not given.

The two case shells 11 and 12 releasably join one another at a separation line extending along the top and two end walls with the hinge 13 pivotally relating the shells along the bottom wall. As shown best in FIG. 8, a peripheral groove 28 extends completely about the luggage case including the case separation line and the pull handle apparatus 16 is received within this groove.

For the ensuing description of the pull handle apparatus 16, reference is made to FIGS. 3–7. The pull handle 29 is an elongated member generally U-shaped in transverse section with side walls 30 and formed over-ends providing a hollowed-out back or under side. An elongated slide 31, having a hook 32 at one end and a finger-operated actuator 33 at the other end, is so dimensioned as to permit receipt within the pull-handle. More particularly, the slide 31 is received within the handle with the actuator 33 extending outwardly of the handle free end through an opening provided therein. Studs 34 and 35 secure the slide within the handle on passing through correspondingly located elongated openings 36 and 37 in the slide body, thereby providing the slide with a limited longitudinal movement relative to the handle. A coil spring 38 has one open end loop anchored in a further slide opening 39 and the other open end loop received on stud 40 mounted to the handle side walls. The coil spring 38 resiliently urges the slide 31 to the lowermost position in the handle as it is depicted in FIG. 7, with the actuator extending beyond the handle end.

A reinforcing strip 41 abuts against the inwardly directed surface of the channel member defining the groove 28 on the front end panel, i.e., the end panel with the pull handle. A guide and positioning block 42 dimensioned for receipt within the upper end cavity of the handle 29 is affixed to the groove wall and reinforcing strip 41 by a plurality of rivets 43. The upper handle end 44 is fittingly received onto the guide block 42 and pivotally related thereto by a pin or stud 45 which passes through the handle side walls and an opening 46 in the block. When so connected, the handle is pivotable toward and away from the luggage case front end panel with the pin 45 as axis.

Figures 3, 4, 5, 6:
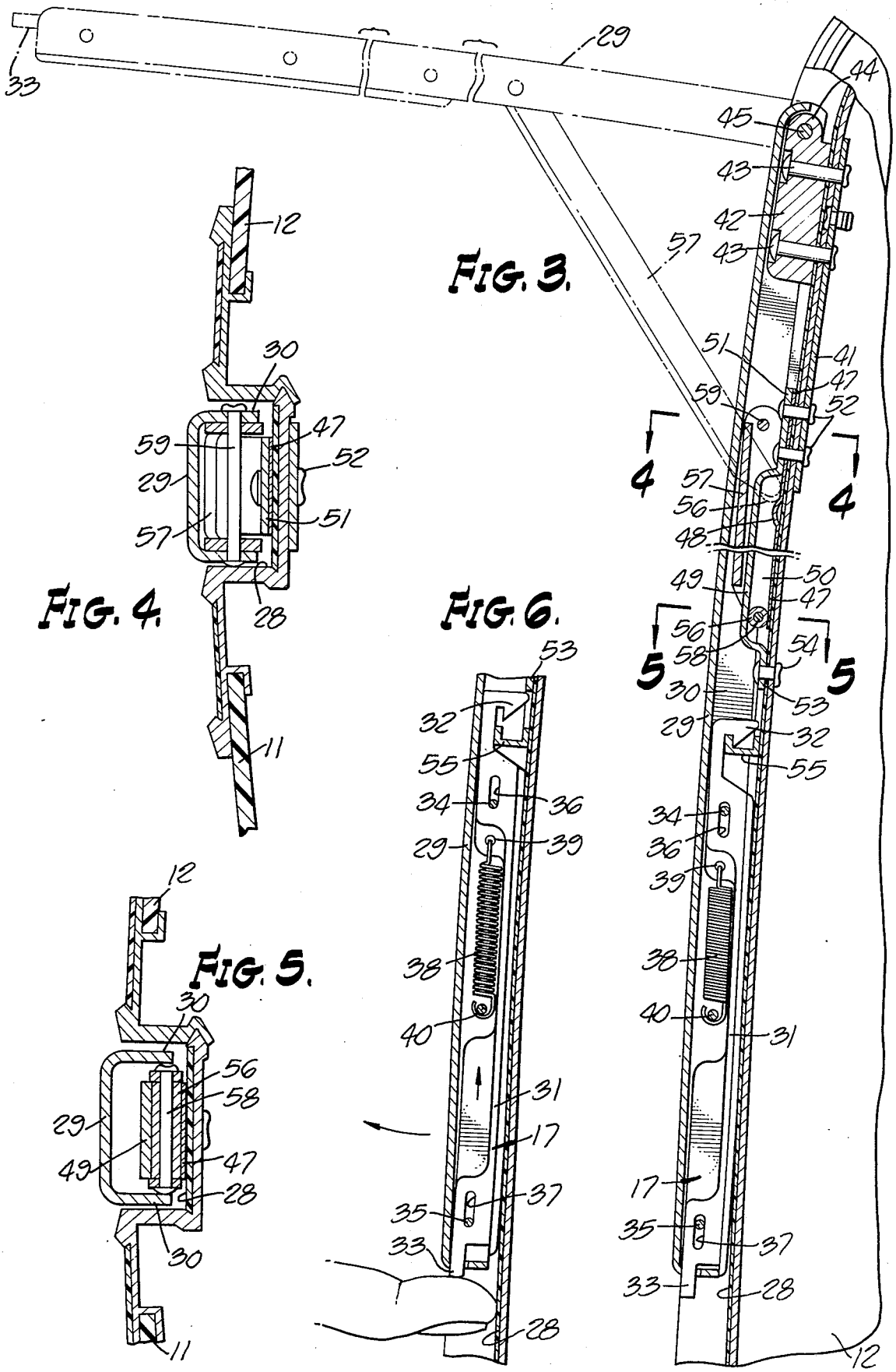
FIG. 3 is a sectional view taken along lines 3—3 of FIG. 1 with the handle shown extended in phantom line.
FIG. 4 is a sectional, plan, partially fragmentary view taken along line 4—4 of FIG. 3.
FIG. 5 is a sectional, plan view similar to FIG. 4, taken along line 5—5 of FIG. 3.
FIG. 6 is a side elevational view similar to FIG. 3, showing operation of means for releasing the handle to its extended position.

A locking plate 47 is a rectangular elongated strip received within the groove 28 immediately below the guide block 42, and includes a projecting portion or lock 48 spaced from its upper end for a purpose to be described. An elongated spacer plate 49 is located over the plate 47 and has a generally C-chaped central portion providing a space 50 between the two plates (FIG. 3). Specifically, one end portion 51 of the plate 49 is secured together with the plate 47, groove wall and reinforcing plate 41 by means of rivets 52, and the plate separation space 50 encompasses the major length of plate 47, the locking projection 48 and further portion just beyond the projection.

The opposite end portion 53 of plate 49 is anchored to the groove wall by a rivet 54, and has its outer end formed into a hook 55 of dimensions and configuration for cooperative engagement with the hook 32 on the slide plate 31.

A hollow roller 56, of length less than that of the groove, is disposed within the space 50 between the plates 47 and 49. The roller is of such cross-sectional dimension that it is readily moved along the space 50, except that movement over the locking projection 48 is resisted by the inherent resiliency of the plate material.

A bifurcated brace arm 57 has one end pivotally secured to roller 56 by a pin 58 which maintains the roller 56 within the space 50 for rolling movement therealong. The other end of brace 57 is pivotally related to the handle 29 by a pin 59 at a pivot axis spaced from the pin 45.

As shown in FIGS. 3 through 5, when the pull handle apparatus is retracted, it is entirely received within the end panel groove, its outermost parts being substantially coextensive with the end panel outer surface. Accordingly, when the pull handle apparatus is retracted, the luggage case has the outward appearance as in FIGS. 1 and 2, and may be handled very much as any other luggage case, i.e., carried by the handle 14 or set down on its feet 15. With the wheel assembly located at the edge of the end and bottom panels (i.e., spaced upwardly from the bottom panel), the case can be tipped, moved or slid about on the feet 15 in the same manner as other luggage items.

It is also important to note (FIG. 3) that when in retracted mode the slide hook 32 is lockingly engaged with the hook 55 serving to maintain handle apparatus retracted and prevent inadvertent release.

To use the described luggage in its pulling mode, upwardly directed finger pressure on the actuator 33 releases the hook 32 and the handle is now swung outwardly away from the end panel (arrow) and upwardly to the phantom-line position shown in FIG. 3. In the extended position, the handle is substantially normal to the front end panel and generally parallel to the case top panel while spaced slightly downwardly therefrom. On moving the handle to its fully extended position, the brace 57 moves the roller 56 upwardly along the plate separation space 50, past the projection 48 where resilient interference is encountered, and is lockingly retained between the projection 48 and the oppositely located parts of plate 49 (phantom line depiction in FIG. 3) when the handle reaches its upper limit.

Figure 10:
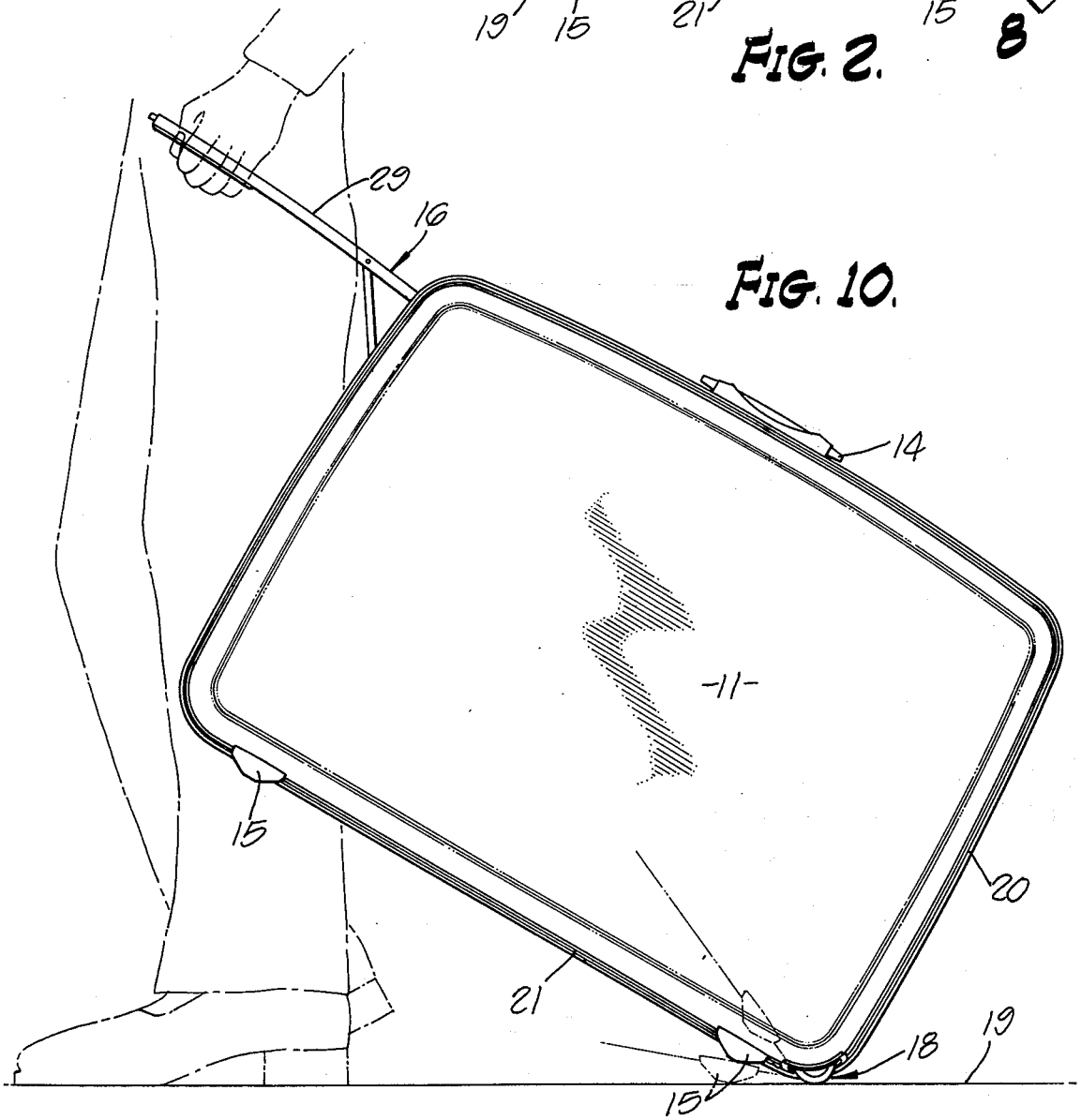
FIG. 10 is a side elevational view illustrating the luggage case of this invention being pulled.

As shown in FIG. 10, the case is transported by merely lifting the handle sufficiently to pivot the case off its rear feet and onto the wheel assembly. To retract the handle, the handle is merely pushed downwardly with sufficient force to overcome the roller interference with the projection 48, followed by further downward handle movement until it swings into the groove 28 and hook 32 engages the hook 55.

We claim:

1. A mobile luggage case, comprising, in combination:

top, bottom, front and rear end, and two side panels joined together to form a storage space enclosing container, said front end panel including walls defining an externally opening groove;

feetlike means on said bottom panel extending from said bottom panel outer surface;

a wheel assembly mounted on said container at the juncture of the rear end and bottom panels, said wheel assembly including wheel parts extending outwardly from said bottom and rear end panels; and handle means pivotally connected to said walls defining said groove for movement from a first position retracted within said groove to a second position extending substantially normal to said front end panel, in which said handle means includes, an elongated handle pivotally connected at one end within the groove, a first hook mounted within said groove, and a second hook carried by said handle for cooperative locking engagement with said first hook on said handle being pivoted into said groove.

2. A mobile luggage case as in claim 1, in which the feetlike means lie in substantially a single plane, and said wheel assembly including wheels extending from said container at such a relative distance that with the feetlike means resting on a flat surface, the plane of said feetlike means must be rotated through an angle of about 13° to bring the wheels into contact with said flat surface.

3. A mobile luggage case as in claim 2, in which there are further provided finger actuated means carried by said handle and located within said groove for selectively releasing said first and second hooks from engagement with each other.

4. A mobile luggage case as in claim 1, in which there are further provided a brace having one end pivotally connected to said handle means and its other end received within said groove and adapted for movement therealong responsive to handle means movement.

5. A mobile luggage case as in claim 1, in which said wheel parts are each journaled for rotation about an axis that is automatically positionable responsive to pressure on said wheel parts.

6. A mobile luggage case as in claim 1, in which said wheel parts include a pair of wheels for rotation, mounted about separate axes, each such axis being individually shiftable responsive to pressure on the periphery of the respective wheel.

7. A mobile luggage case as in claim 1, in which the wheel parts include a pair of spaced apart wheels mounted on separate axles, each axle having one end substantially fixedly journaled and its other end journaled for shifting movement a predetermined amount responsive to pressure on the respective wheel.

8. A mobile luggage case as in claim 1, in which the wheel parts include a pair of wheels mounted on separate axles, each axle having one end fixedly rotatably mounted and its other end received within an oversize slot whereby said axles can both rotate and shift in the plane of the respective slots.

9. A luggage case, comprising:

top, bottom, front and rear end, and two side panels joined together to form a storage space enclosing container, said front end panel including walls defining an externally opening groove;

feetlike means on said bottom panel extending from said bottom panel outer surface;

a wheel assembly mounted on said container at the juncture of the rear end and bottom panels, said wheel assembly including wheel parts extending outwardly from said bottom and rear end panels; and handle means pivotally connected to said walls defining said groove for movement from a first position retracted within said groove to a second position extending substantially normal to said front end panel;

said handle means including an elongated handle pivotally connected at one end within the groove, first hook means mounted within said groove, and second hook means carried by said handle for cooperative locking engagement with said first hook on pivoting said handle into said groove.

10. A luggage case as in claim 9, in which the feetlike means lie in substantially a single plane, and said wheel assembly includes wheels extending from said container at such a relative distance that with the feetlike means resting on a flat surface, the plane of said feetlike means must be rotated through an angle of about 13° to bring the wheels into contact with said flat surface.

11. A luggage case as in claim 10, in which there are further provided finger actuated means carried by said handle for selectively releasing said first and second hooks from engagement with each other.

12. A luggage case as in claim 9, in which there are further provided a brace having one end pivotally connected to said handle and the other end received within said groove and adapted for movement therealong responsive to handle means movement.

13. A luggage case, comprising, in combination:

top, bottom, front and rear end, and two side panels joined together to form a storage space enclosing container, said front end panel including walls defining an externally opening groove;

feetlike means on said bottom panel extending from said bottom panel outer surface;

a wheel assembly mounted on said container at the juncture of the rear end and bottom panels, said wheel assembly including wheel parts extending outwardly from said panels;

said feetlike means lying in substantially a single plane, and said wheel assembly including wheels extending from said container at such a relative distance that with the feetlike means resting on a flat surface, the plane of said feetlike means must be rotated through an angle of about 13° to bring the wheels into contact with said flat surface;

handle means pivotally connected to said walls defining said groove for movement from a first position retracted within said groove to a second position extending substantially normal to said front end panel;

said handle means including a handle pivotally connected at one end within the groove, means located within said groove cooperating with means carried by said handle for releasable locking engagement on said handle being pivoted into said groove;

finger actuated means carried by said handle and located within said groove for selectively releasing said means located within said groove from engagement with means carried by the handle; and a brace having an end pivotally connected to said handle and another end received within said groove for sliding movement therealong responsive to handle movement.

* * * * *